US006413150B1

(12) United States Patent
Blair

(10) Patent No.: US 6,413,150 B1
(45) Date of Patent: Jul. 2, 2002

(54) DUAL DICING SAW BLADE ASSEMBLY AND PROCESS FOR SEPARATING DEVICES ARRAYED A SUBSTRATE

(75) Inventor: David B. Blair, Blue Ridge, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/575,477

(22) Filed: May 19, 2000

Related U.S. Application Data

(60) Provisional application No. 60/136,179, filed on May 27, 1999.

(51) Int. Cl.[7] ..... B24B 1/00
(52) U.S. Cl. ..... 451/41; 451/12
(58) Field of Search ..... 451/41, 5, 9, 12; 125/12, 13.01, 15, 20

(56) References Cited

U.S. PATENT DOCUMENTS 2,762,954 A * 9/1956 Leifer ..... 257/41
4,006,656 A * 2/1977 Shinomiya ..... 83/864
5,435,876 A * 7/1995 Alfaro et al. ..... 156/247
5,458,034 A * 10/1995 Cavagna ..... 83/488
5,551,327 A * 9/1996 Hamby et al. ..... 83/508.3
5,824,177 A * 10/1998 Yoshihara et al. ..... 156/250
6,006,739 A * 12/1999 Akram et al. ..... 125/23.01

* cited by examiner

*Primary Examiner*—Joseph J. Hail, III
*Assistant Examiner*—David B. Thomas
(74) *Attorney, Agent, or Firm*—Gary C. Honeycutt; Fred Telecky; Arthur I. Navarro

(57) ABSTRACT

A dicing saw blade assembly with parallel blades separated by a spacer and attached to a single spindle on an automated dicing saw, is applicable to precisely separating CSP or MCM devices which have been fabricated on a polymeric substrate. Two parallel cuts are made simultaneously in the scribe streets of the substrate to separate the flip chip devices. The substrates are diced from the bottom side, thereby allowing use of thin blades for separating devices having relatively thick chips, as well as chips with attached heat spreaders.

4 Claims, 6 Drawing Sheets

DUAL DICING SAW BLADE ASSEMBLY AND PROCESS FOR SEPARATING DEVICES ARRAYED A SUBSTRATE

This application claims priority from Provisional application Ser. No. 60/136,179, filed May. 27, 1999.

FIELD OF THE INVENTION

The present invention related generally to the dicing of semiconductor devices and more specifically to a saw blade assembly for separating devices on an unsupported substrate.

BRIEF DESCRIPTION OF RELATED ART

In the semiconductor industry separation of a processed wafer into its individual chips has evolved from techniques such as scribing and breaking, or laser dicing into an automated process using a dicing saw with a rotating circular blade. The process and equipment allow automation, accuracy, cleanliness, and versatility in selection of depth and width of the cut, and has become the technique employed throughout the industry.

Typically a semiconductor wafer is supported on a flat, rigid vacuum chuck and a high speed rotating blade with embedded hard, abrasive particles is programmed to saw the streets between the chips in first the "x" direction, and then the substrate is rotated ninety degrees to saw in the transverse direction. As complexity of the devices has increased expensive and dissimilar materials are often combined to produce multiple layers in the devices which adds to the difficulty of dicing accurately.

The abrasive material of the saw blade is most frequently diamond particles embedded in a softer material matrix to form blades. The exposed portion of the dicing blades are thin, in the range of 0.0005 to 0.002 inches thick which enables cutting to precise dimensions with smooth edges defined on the diced object, while minimizing the amount of costly semiconductor substrate abraded during the process. The exposed area of the blade is sufficiently large enough to saw completely through the object, but is kept as small as possible in order to minimize breakage.

In a typical dicing or sawing system, the fragile blade 101 is mounted on a spindle 104 as shown in FIG. 1*a* with a pair of flanges 103 to support the blade 101. A clearance 105 must be allowed between the flange and material to be diced 110. The clearance will change as the blade is eroded, but it must be controlled to avoid contact with the dicing subject, but yet kept as small as practical in order to avoid breaking the fragile blade. A cross-sectional view of the blade assembly is shown in FIG. 1*b*.

The material to be diced 110, typically a semiconductor wafer is positioned on a piece of plastic carrier film ofter with a uv release adhesive which is secured in a supporting ring (not shown). The wafer on the tape carrier is held securely on a work surface, typically a vacuum chuck 120. Flowing water is used to cool the blade and target material, and to remove the particulate matter eroded during the sawing process.

At the semiconductor supplier, it is desirable to use the same dicing equipment not only to separate integrated circuit chips on wafers, but more recently to singulate a plurality of devices fabricated on a single circuit substrate. The substrate provides the next level of interconnection, such as a package level printed wiring circuit. Circuit substrates for integrated circuit packages are made of unfilled flexible polymeric materials such as Kapton or Upilex, of filled polymeric materials such as FR-4, FR-5 or other polymers with either fiber of particulate fillers, or of rigid, ceramic like materials. The interconnection traces are typically copper with a protective coating. Thickness of the substrates varies greatly from 0.003 inches to 0.030 inches.

The circuit substrates may further have the individual or multiple chips attached to form either an integrated circuit package, such as a Chip Scale Package (CSP) FIG. 2*a*, a larger similarly designed Ball Grid Array Package (BGA) or a multichip module MCM) as shown in FIG. 2*b*. The CSP device is generally characterized as having a package area no greater than 1.5 times that of the chip itself. A configuration, as shown in FIG. 2*a*, consists of a chip 210 electrically connected to a printed wiring substrate 202 by a plurality of small solder balls 211. Conductive vias (not shown) through the substrate provide contact to an array of pads, each of which has a larger solder ball 221 for making electrical contact to the next level of interconnection, typically a printed wiring board. A multichip module in FIG. 2*b* is similarly constructed by connecting a plurality of chips 240 to a printed circuit board substrate 242. Conductive traces (not shown) on the substrate allow connections to be made between the chips, as well as provide a means for contact to the next level of interconnection, such as solder balls 241.

Manufacturing and cost advantages of assembling a plurality of these devices as a single unit are numerous; equipment, space, labor, time and materials may all be utilized more economically and effectively by multiple, rather than single unit assembly.

However, accurately separating the substrate into individual devices having chips ranging from 0.010 to 0.050 inches in thickness presents a number of problems. As the distance between the vacuum chuck and the subject to be diced becomes larger, vibration of the high speed rotating blade may increase and add to the risk of damage to both the expensive circuits and the expensive blade. Variations in the elastic modulus of the materials to be diced contributes not only to vibration damage, but also to contamination of the saw blade with a non-abrasive, resinous material which may hinder the blade efficiency.

Unsupported structures present a particularly significant challenge to the dicing operation because they tend to tear or break rather than saw completely and cleanly.

Sawing polymeric substrates for devices such as CSP or BGA packaged integrated circuits or multichip modules presents significant challenges because the thickness of the device has increased while the dimensional precision and smoothness of the substrate edges remains unchanged. The devices require very precise control of the package dimensions and uniformity in order to insure reliable electrical contact to a test socket. Poor edge definition of the substrate can result in test yield failure at this final stage of assembly, resulting in the most costly losses. To allow dicing accuracy, the saw blades must be thin, and consequently they are somewhat fragile.

A need exists to provide a solution for precisely dicing substrates with an array of chips attached using the existing automated dicing equipment.

SUMMARY

The principal object of the present invention is to provide a saw blade assembly for precisely separating a plurality of integrated circuit packages arrayed on a substrate. A dual saw blade assembly wherein the parallel blades are separated by a spacer and supported on the single spindle of an automated dicing system, provides a means of economically utilizing existing equipment to dice the substrate with assembled devices at very precise locations.

A dual saw blade assembly allows the use of commercially available, narrow blades, and the separation between blades is adjusted simply by selection of an inexpensive spacer or spacers inserted between the blades. Flanges are positioned on the outer surface of each blade to support the assembly, in a manner similar to the single blade assembly.

The substrate is diced from the backside in order to minimize blade exposure and to allow singulating devices much taller than the blade exposure, including devices having heat spreaders attached to the device surface.

Integrated circuit devices such as Chip Scale Packages (CSP) or Multichip Modules (MCM) fabricated on polymeric substrates require accurate sizing and precise edge acquity in order to accurately mate with contacts in test sockets. Such devices having flip chip connections are surrounded by an uneven polymeric material exuding from under the devices. This underfill material requires that the scribe streets be sufficiently wide to accommodate the out-flow, rather than abutting or closely spacing the devices. The saw blade assembly of the current invention provides a means for removing the wide streets by making two cuts simultaneously, thereby avoiding issues found when dicing unsupported structures by making two cuts with a single blade assembly. Further, the dual blade assembly decreases the process time required by making a single cut as opposed to two passes with a single blade.

The saw blade assembly is further capable of removing unwanted structures in scribe streets by selecting a spacer with width equal to or greater than the unwanted structure and the combined widths of blades and spacer is within the width of the scribe street. The blades are aligned to the street, making a single cut and enabling removal of the unwanted structures without contaminating the device from debris.

DETAILED DESCRIPTION OF THE PREFERRED EMBODIMENT

Figure 1A:
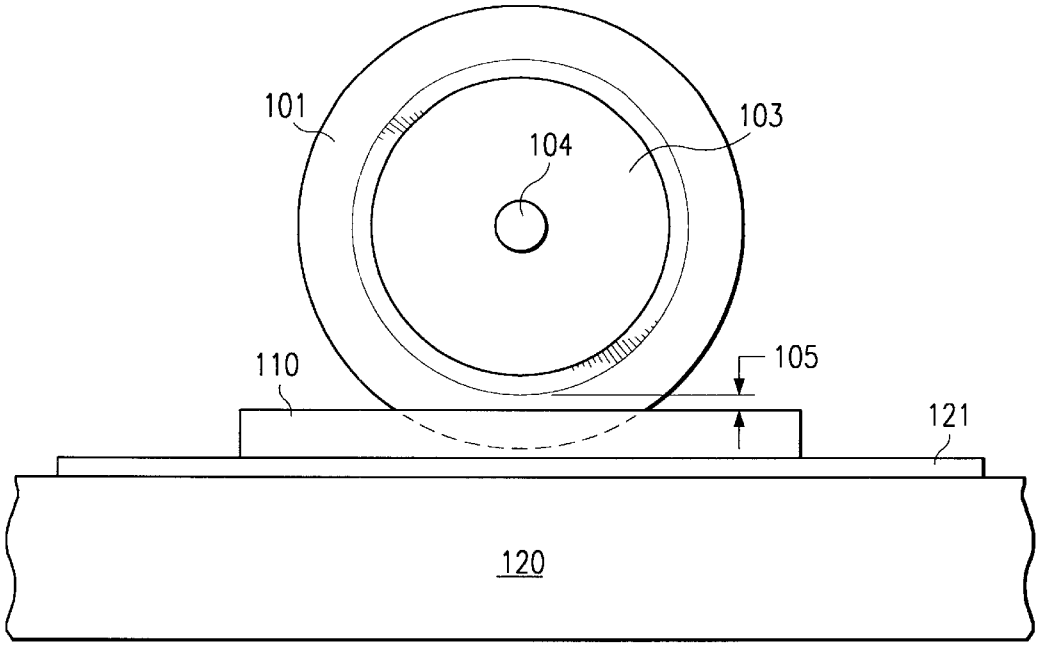
FIG. 1*a* illustrates a rotating saw blade assembly (prior art).
Figure 1B:
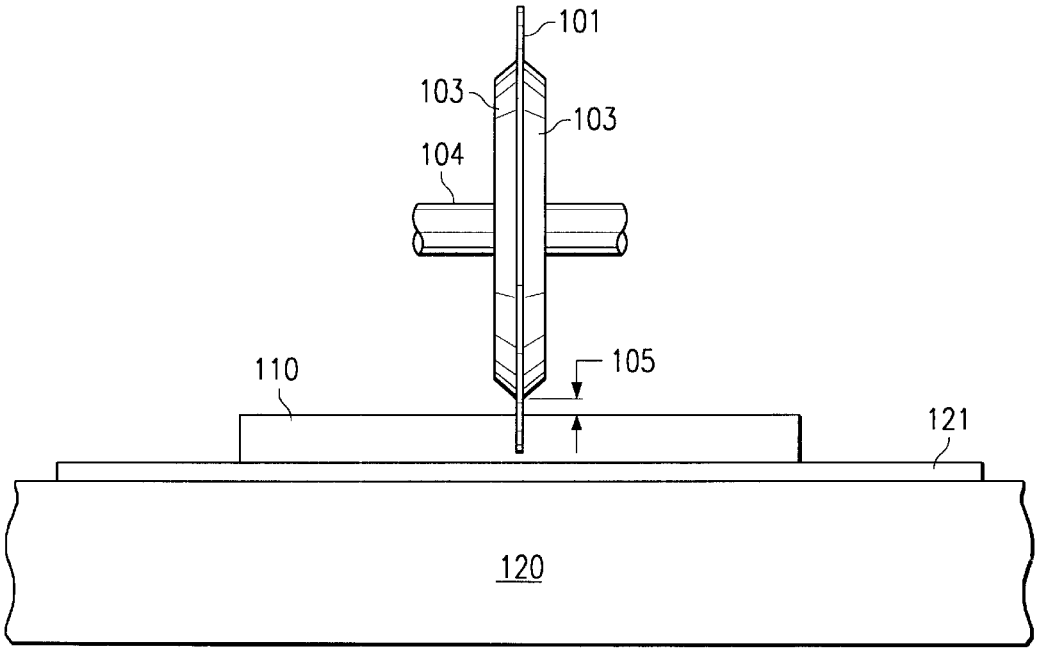
FIG. 1*b* is a cross-sectional view of a saw blade assembly (prior art).
Figure 2A:
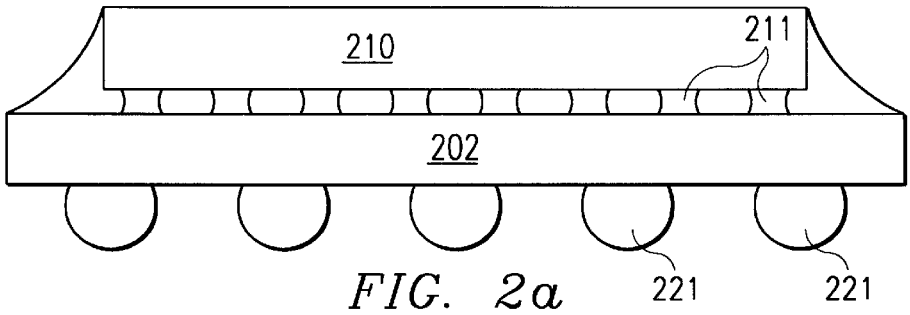
FIG. 2*a* illustrates a cross section of a flip chip Chip Scale Package (CSP) (prior art).
Figure 3A:
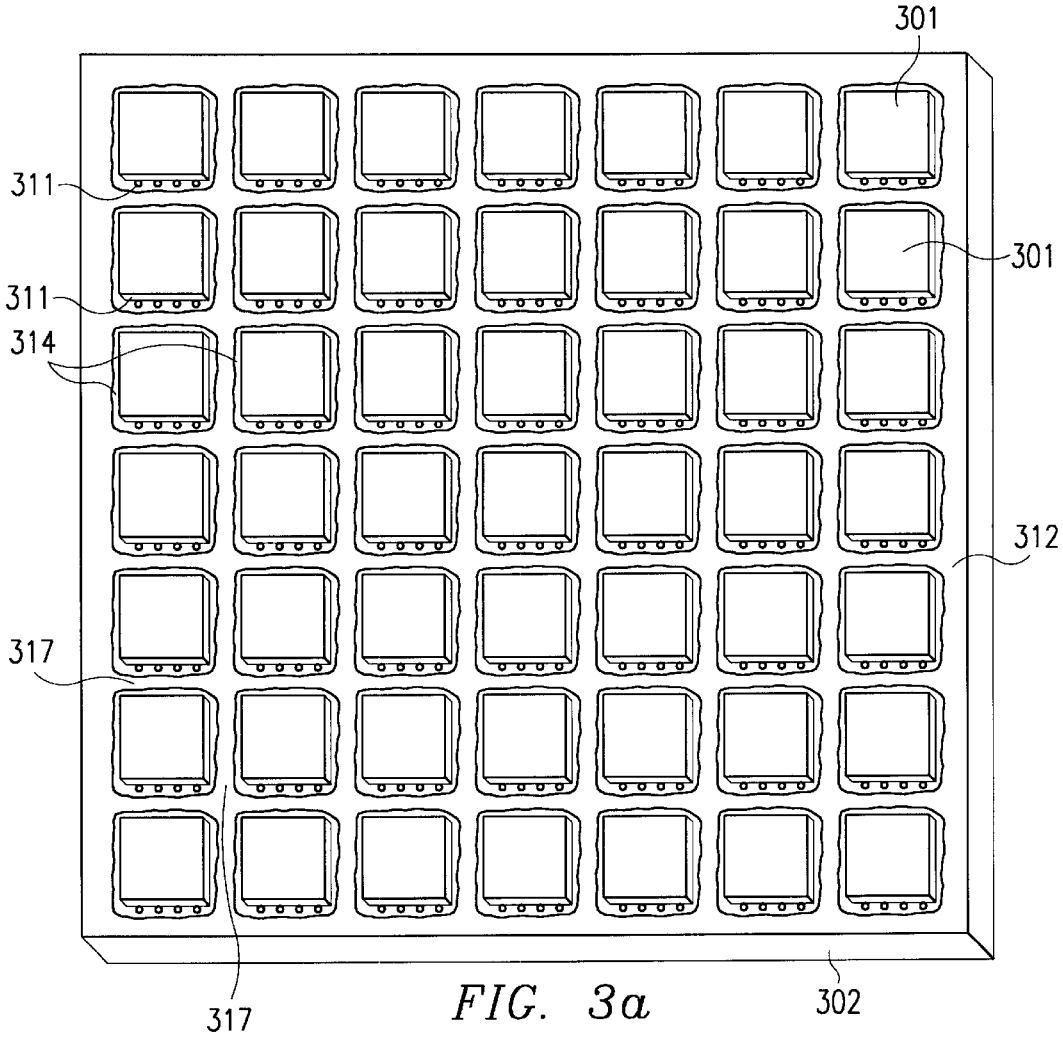
FIG. 3*a* is a top view of an array of flip chip CSP devices on a single substrate.

FIG. 3 illustrates a circuit substrate 302 with a plurality of flip chip bonded Chip Scale devices (CSP) 301, such as those shown in FIG. 2*a*. The devices are arrayed in a defined pattern on the first surface 312 of the substrate with scribe streets 317 between the devices. A Chip. Scale Package is generally defined by having the package area no greater than 1.5 times that of the chip. The chips 301 are electrically connected to a printed circuit pattern (not shown) on the first surface 312 of the substrate 302 by flip chip contacts 311, such as solder bumps. A polymeric material known in the industry as "underfill" 314 in has been forced while in liquidus form to flow under the chip. After curing, the underfill polymer has been shown to absorb stresses on the flip chip contact bumps resulting from thermal mismatches between the chip and substrate. It can be seen in FIG. 3*a* that the underfill material 314 extends outside the chip area to form irregular shaped fillets, and further that the extent of out-flow varies from chip-to-chip. As a result of the out-flow of underfill material, the chips cannot be abutted, but instead are spaced with relatively wide streets on the substrate. Because the unpatterned substrate is relatively inexpensive, the spacing does not present a significant problem.

Figure 3B:
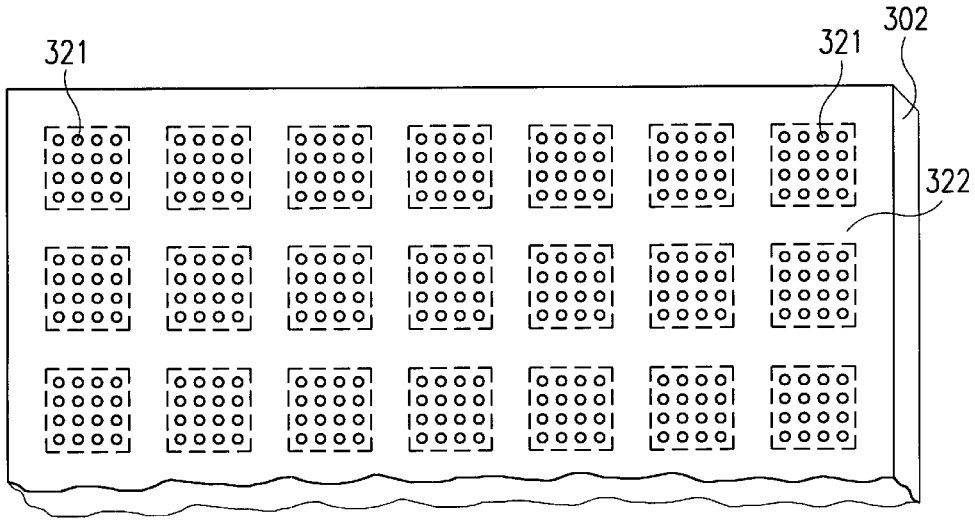
FIG. 3*b* shows a substrate with an array of flip chip CSP devices from the external solder ball contact surface.

The second surface 322 of the circuit substrate, as illustrated in FIG. 3*b*, holds an array of solder balls 321 protruding from the substrate surface for each CSP. These solder balls will provide electrical contact between the device and an external circuit board. The solder balls also are used to make pressure contact to a test socket for electrical verification of the device.

Figure 4A:
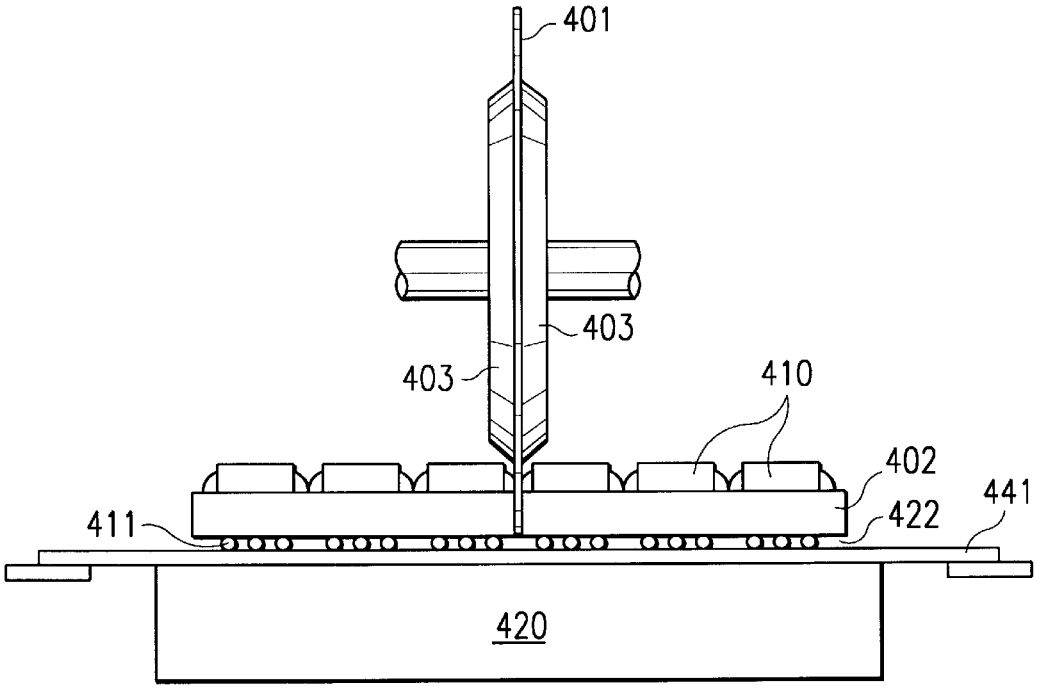
FIG. 4*a* demonstrates the saw blade exposure required to dice a substrate with an array of CSP devices from the chip surface (prior art).

FIG. 4*a* illustrates some of the problems encountered with dicing a circuit substrate 402 in the conventional manner used for dicing silicon wafers, i.e., from the top surface. For substrates with solder bumps 411 on the bottom or second surface 422 of the substrate, the rounded surface of the solder balls 411 would provide poor contact area with the carrier tape 441, and the height of silicon chips 410 above the substrate 402 would require a large exposure of the blade 401. The large, thin blade exposure coupled with the vibration from poor contact would result in a high risk of blade breakage, and is therefore an unacceptable configuration.

Alternately a wide blade could somewhat compensate for the vibration, but would provide unsatisfactory edge acquity and would result in a large amount of debris from the abraded substrate to contaminate the devices.

Figure 4B:
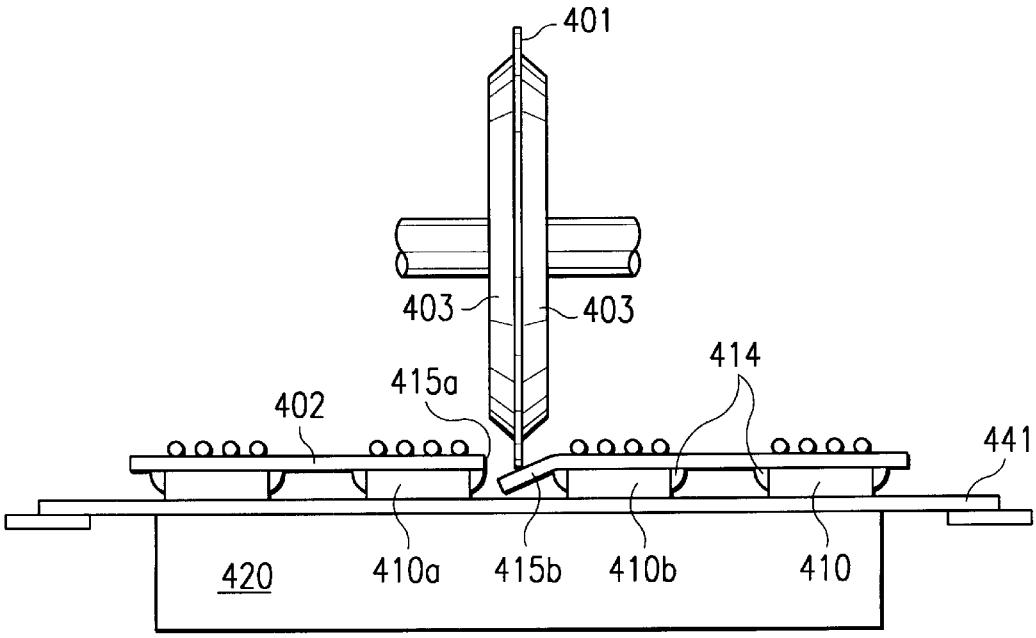
FIG. 4*b* demonstrates dicing an unsupported substrate (prior art).

FIG. 4*b* demonstrates the problem of inverting the assemblage to be diced, whereby the chips 410 are attached to the carrier tape 441 and the substrate 405 is diced from the surface opposite the chips. The back side or unpatterned surface of the chips has sufficient surface area and smoothness to allow acceptable adhesion of the structure, and the height of the circuit substrate alone does not require a large blade exposure, as was the case in FIG. 4*a*. However, the wide street made necessary by run out of underfill material 414 requires that more than one saw cut be made in order to conform to the small dimensions of a CSP device. From FIG. 4*b*, it can be seen that the substrate is diced in close proximity to device 410*a* at location 415*a* leaving the location for a second cut at position 415*b* be unsupported. The unsupported circuit substrate bends and either tears or breaks as the blade attempts to make a second cut, and the second cut results in incomplete cuts and irregular shaped devices. Such devices with poorly defined edges and inconsistent sizes can not make proper contact to test sockets, and result in yield loss at a very costly point in the fabrication of semiconductor devices.

Figure 5:
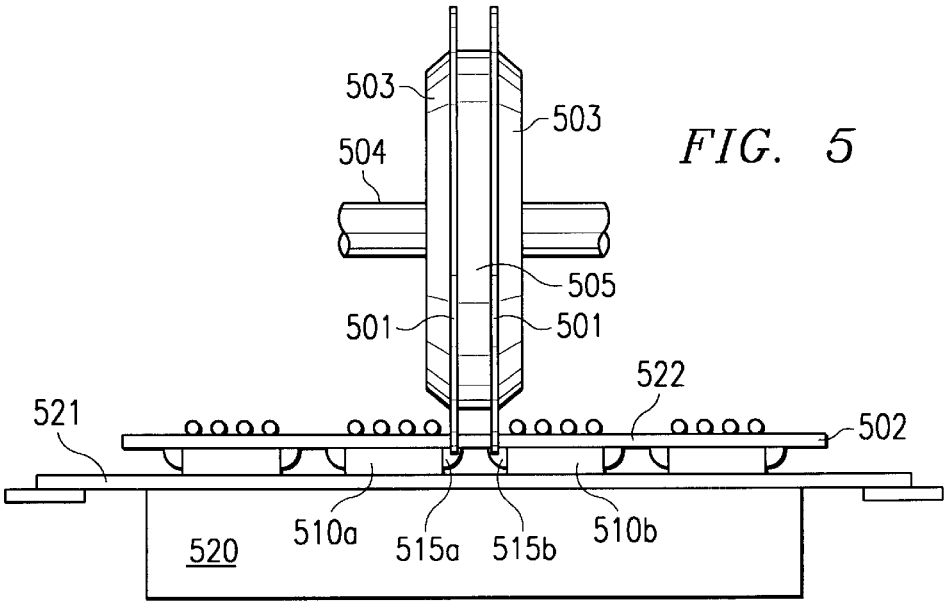
FIG. 5 shows a cross sectional view of a dual saw blade assembly of the current invention.

The dicing saw blade assembly of the current invention is illustrated in FIG. 5. Two saw blades 501, separated by a spacer 505 are positioned on the single spindle 504. The spacer 505 and two blades 501 are supported by a pair of flanges 503, and the that assembly is affixed to the spindle 504 by a threaded nut or other means as provided by the saw manufacturer for a single blade assembly. Simultaneous cuts are made in the circuit substrate 502 at locations 515*a* and 515*b*, which are in close proximity to the chips 510*a* and 510*b*. The substrate 502 is inverted for dicing from the second surface 522 with the unpatterned surface of the chips 510 attached by a uv release adhesive to the carrier tape 521. The carrier tape 521 with ring support is held securely on the vacuum chuck 520, as is done with conventional dicing processes.

In a preferred embodiment, the two commercially available diamond saw blades are in the range of 0.001 to 0.002 inches thick with a blade exposure in the range of 0.030 to 0.075 inches which will allow accurate dicing of a circuit substrate in the range of 0.005 to 0.010 inches thickness, having chips in the range of 0.015 to 0.040 thickness. The spacer is a metal disc, such as aluminum. Thickness of the spacer is determined by the widths of the final device substrate and streets on the undiced substrate. By way of example, for a street width of about 0.050 inches, and a substrate extension from the chip edges of about 0.005 inches, the spacer thickness is in the range of 0.030 to 0.040 inches. The assembled blades, spacer and flanges are secured on the spindle using the mechanism provided by the dicing equipment vendor, or by a threaded nut.

The dual blades are aligned within the streets on the substrate surface 522. The blades will contact the substrate at sites which are predetermined by the package size, and which exceed the area of the chips. Dicing saw parameters of speed, depth of cut and water flow rate are programmed into the automated saw.

Figure 6A:
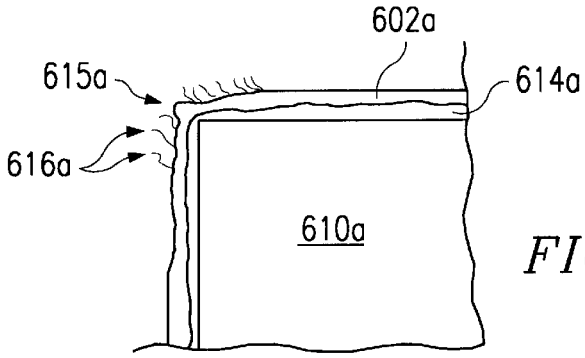
FIG. 6*a* illustrates poor substrate edge definition from dicing an unsupported substrate with a single blade (existing art).
Figure 6B:
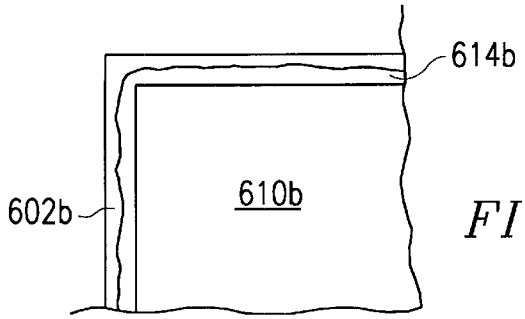
FIG. 6*b* illustrates substrate edge definition achieved with a dual blade assembly of the current invention.

An example of a substrate edge achieved by using a single blade as illustrated in FIG. 4*b* with two cuts of a single saw blade is compared in FIG. 6*a* to that of a substrate from the dual blade assembly with simultaneous cuts in FIG. 6*b*. It can be seen that the substrate 602*a* having been diced by a single blade making two cuts has an undersized corner 615*a* with frayed edges and a number of fiberous protrusions 616*a* from the substrate filler. In FIG. 6*b* the substrate 602*b* having been diced using the dual blade saw configuration of this invention has sharp corners and edges with only a single residual fiber. The chips 610*a* and 610*b* and the underfill material 614*a* and 614*b* are similar in the two cases.

A substrate with poor edge resolution such as that illustrated in FIG. 6*a* will not seat solidly into a test socket, and may result in inaccurate values which in turn cause yield degradation of the device.

By simultaneously making parallel cuts the problem of accurately separating a substrate requiring multiple cuts, some of which are unsupported, is resolved. The spacer thickness, coupled with width of the blades controls the street width to be removed, and the width is readily adjusted by changing spacers or adding additional spacers. Advantages to the two blade configuration are that it enables dicing unsupported structures, minimizes the number of cuts required and thus the process time, provides very precise dimensional control of the device with uniform smooth edges. It also cleanly eliminates the material within the street by cutting and removing, rather than grinding the excess substrate material. Grinding or abrading the substrate can result in excessive amounts of contamination which may deposit on the device and contribute to poor electrical contact.

Figure 2B:
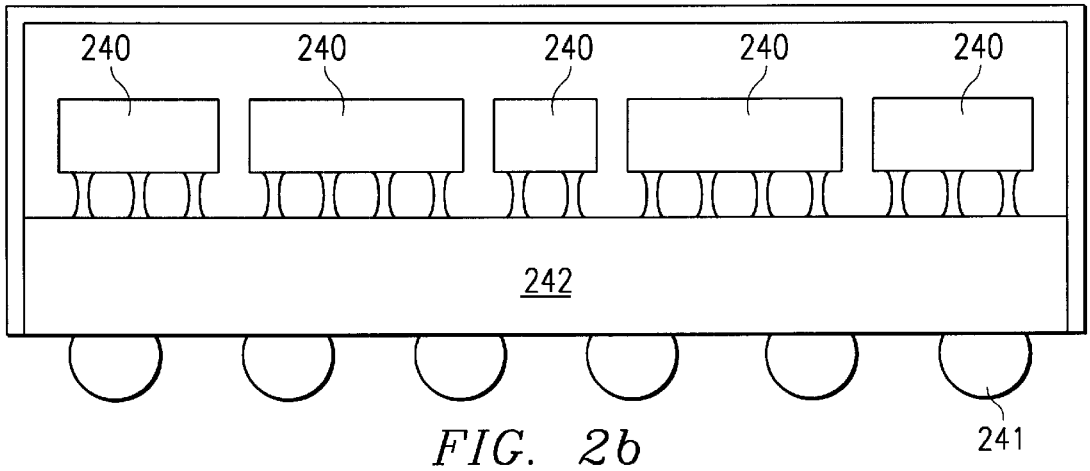
FIG. 2*b* illustrates a cross section of a multichip module with flip chip interconnections (prior art).

An alternate application of the dual blade saw assembly, and process is separating multichip modules (FIG. 2*b*) having flip chip contacts to a polymeric substrate. The ability to singulate the module substrate close to the chips supports minimizing module area. Wide streets having no circuitry or simple alignment structures are an attractive alternative to increasing the module substrate area. Further, in conventional saw processes the chip height may interfere with the flange clearance as illustrated in FIG. 4*a*, whereas the inverted substrate process is not limited by chip height. Multichip modules are subject to the same testing placement accuracy as discussed previously for CSP devices, and therefore require close size tolerance.

Figure 7A:
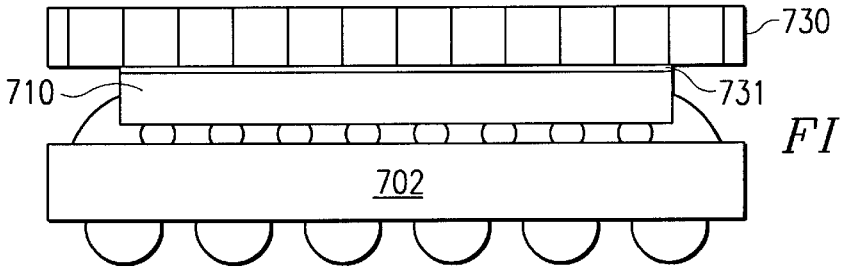
FIG. 7*a* shows a cross section of a CSP having an attached heat spreader.
Figure 7B:
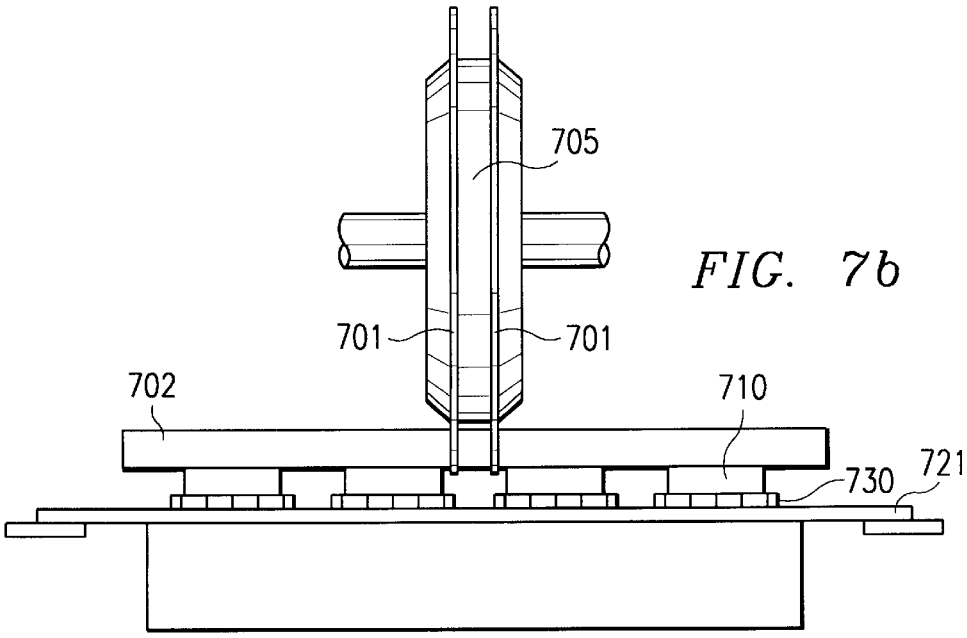
FIG. 7*b* demonstrates dicing a substrate with an array of CSP devices having attached heat spreaders with a dual blade saw assembly.

A further application of the current invention is in dicing substrates for either single chip and multichip devices having heat spreaders attached to the chips, as shown in FIGS. 7*a* and 7*b*. In CSP or multichip packages heat spreaders are frequently attached to the chips for the purpose of transporting heat generated by the integrated circuit through the chip and into the ambient because the surface area of the substrate for CSP or MCM devices is small, and may have poor to marginal thermal conductivity. A heat spreader, typically a thermally conductive metal is attached to the unpatterned surface of the chip 710 using a thermal grease 731. It is desirable to make the heat spreaders are large as possible, but within the defined area of a CSP, i.e., no greater than 1.5 times the area of the chip. The added height of heat spreaders 730 interferes with dicing, but the advantages of assembling in batch format may be significant, and not unlike those discussed previously, such as equipment, labor and space utilization. Further, a yield advantage is noted during electrical testing of some CSP or MCM devices tested with attached heat spreader.

As shown in FIG. 7*b*, the top surface of the heat spreader 730 contacts the carrier tape 721 and the circuit substrate 702 is diced using a dual blade saw 701 with spacer 705 separating the blades. In this manner, the substrate area of the individual devices can be sized to be equal to the heat spreader area and larger than the chip area, as illustrated.

Figure 8A:
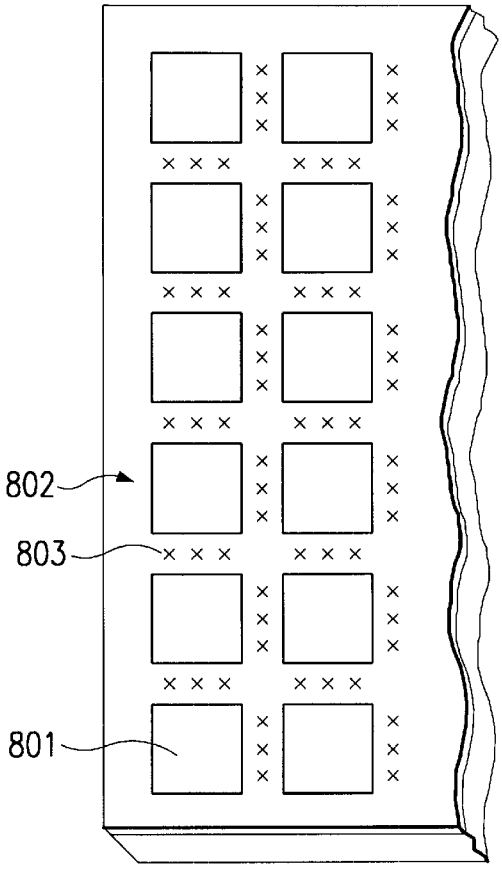
FIGS. 8*a*, 8*b* and 8*c* illustrate an array of devices having unwanted structures in the scribe streets, and removal by using a dual saw blade assembly of the current invention.
Figure 8B:
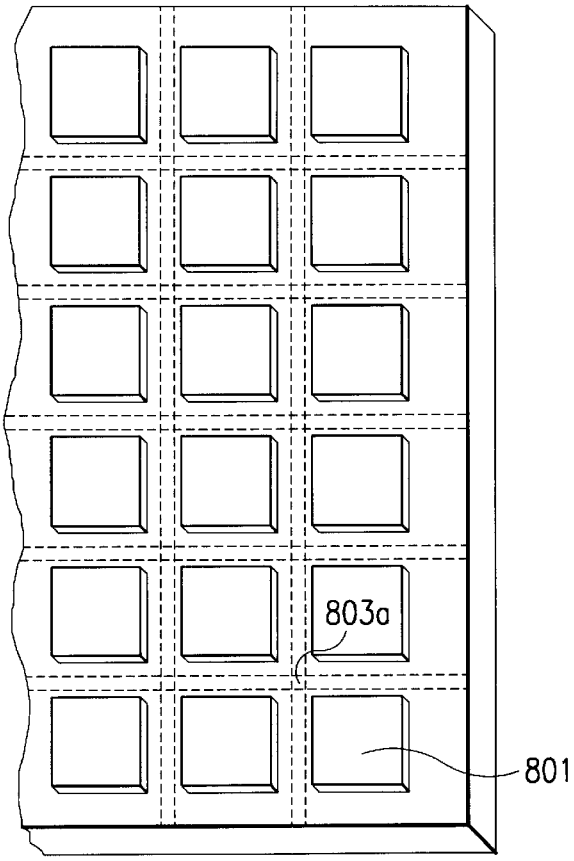
Figure 8C:
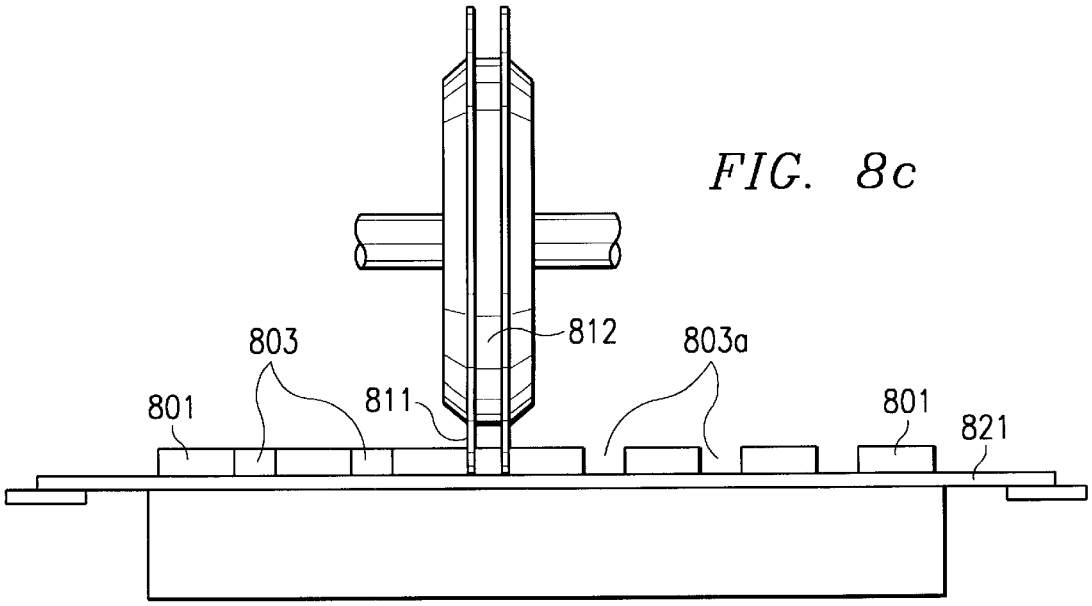

In yet another embodiment, the dual blade dicing saw enables removal of excess portions of the scribe street which contain structures unwanted in the final device. As illustrated in FIGS. 8*a* some devices 801 are assembled on a substrate 802 having alignment structures or in-process test structures 803 patterned in the scribe streets. Such structures, typically a patterned metal, may be both unnecessary and unwanted in the finished product because they may present a risk of electrical shorting in final board assembly. By sawing using a dual saw blade assembly 810, as shown in FIG. 8*c*, the scribe street with unwanted structures can be separated in a single saw pass. The dual saw blades 811 are separated by a spacer 812 whose width is approximately equal to the street width to be removed. The substrate to be diced is positioned on a carrier tape 821 and the saw blades positioned at the edges of device 801 so that in a single pass, the streets and unwanted structures 803 can be removed. Locations 803*a* in FIGS. 8*b* and 8*c* denote the areas where the street material has been dissected and subsequently removed. FIG. 8*b* illustrates a top view of the array of devices 801 after having been diced with a dual blade saw, and the street material removed. Had the array been diced using a single blade configuration, the second cut would be poorly supported, and allow the risk of poorly defined devices. If on the other hand, a wide blade had been attempted, material in the street, including the conductive structures would be pulverized and could contaminate the circuit. This dual saw blade method and blade assembly has been described for top surface dicing, but is equally applicable to inverted substrate dicing.

While a preferred embodiment and some alternate applications of the invention have been described above, it is understood that various modifications may be made from the specific details described herein without departing from the spirit and scope of the invention as set forth in the appended claims.

What is claimed is:

1. A dicing saw assembly to enable removal of intact unwanted structures in scribe streets, said assembly including a pair of parallel saw blades separated by a spacer, wherein the spacer width is equal to or exceeds the width of the unwanted structure and the combined width of spacer and blades is within the scribe street width.

2. A method for separating an array of flip chip bonded Chip Scale Packages on a single substrate including the steps of:

a. adhering the unpatterned surface of the chips to a carrier tape and positioning the tape and substrate on the chuck of a dicing saw, b. aligning a dual blade saw assembly, including two blades separated by a spacer, to precise locations on the back of the substrate, whereby said locations exceed the chip dimensions and define a substrate size, and c. setting the speed and depth of said dicing saw to dice completely through the substrate, and excess underfill material.

3. A method of separating a plurality of devices arrayed on a substrate, said devices having greater height than the dicing blade exposure including the steps of:

a. adhering the surface of the device furthermost from the substrate to a carrier tape and positioning the tape and substrate on the chuck of a dicing saw, b. installing a saw blade or blades having sufficient exposure to cut completely through the substrate in an automated dicing saw, c. aligning the blades to alignment markers on the backside of said substrate, and d. setting the speed and depth of the saw to saw completely through the substrate.

4. A method of removing cleanly unwanted structures in scribe streets including the steps of;

a. selecting a spacer equal to or greater than the width of the unwanted structure, and a pair of saw blades whose width in combination with the spacer is within said scribe street width, b. assembling parallel saw blades having sufficient exposure to cut completely through the scribe street and a spacer on the spindle of an automated dicing saw, c. positioning the device to be sawed on a carrier tape, and positioning the tape and substrate on the chuck of an automated dicing saw, d. aligning the blades to surround the unwanted structures in the scribe streets, e. setting the speed and depth of the saw to saw completely through the scribe streets, and f. mechanically removing the separated unwanted structures.

* * * * *